US007617911B2

(12) United States Patent
Mattila et al.

(10) Patent No.: US 7,617,911 B2
(45) Date of Patent: Nov. 17, 2009

(54) METHOD AND SYSTEM FOR DETECTING AND STOPPING UNCONTROLLED MOVEMENT OF AN ELEVATOR CAR IN AN ELEVATOR

(75) Inventors: Tatu Mattila, Helsinki (FI); Seppo Ketoviita, Hyvinkää (FI); Timo Syrman, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/340,312

(22) Filed: Dec. 19, 2008

(65) Prior Publication Data

US 2009/0133965 A1 May 28, 2009

Related U.S. Application Data

(63) Continuation of application No. PCT/FI2007/000174, filed on Jun. 20, 2007.

(30) Foreign Application Priority Data

Jun. 21, 2006 (FI) ..... 20060611

(51) Int. Cl.
*B66B 1/34* (2006.01)

(52) U.S. Cl. ..... 187/391; 187/288; 187/305; 187/361

(58) Field of Classification Search ..... 187/277, 187/281, 287, 288, 291, 293, 301, 305, 350, 187/351, 361, 373, 391–393
See application file for complete search history.

(56) References Cited

U.S. PATENT DOCUMENTS 4,928,796 A 5/1990 Poon
5,648,645 A 7/1997 Arpagaus et al.
7,228,943 B2 * 6/2007 Kugiya et al. ..... 187/393
7,353,916 B2 * 4/2008 Angst ..... 187/393
7,527,127 B2 * 5/2009 Osterman et al. ..... 187/391
2006/0289241 A1 * 12/2006 Okamoto et al. ..... 187/292
2007/0000736 A1 * 1/2007 Shikai et al. ..... 187/393

(Continued)

FOREIGN PATENT DOCUMENTS

DE 20 2004 010 720 U1 9/2004

(Continued)

*Primary Examiner*—Jonathan Salata
(74) *Attorney, Agent, or Firm*—Birch, Stewart, Kolasch & Birch, LLP

(57) ABSTRACT

Method and system for detecting and stopping uncontrolled movement of the car (1) in an elevator. In the method movement of the car is detected with the first movement detection means (2, 3, 4, 5, 6) when the brake (8) of the drive machinery (7) is in the braking status with the purpose of holding the car in its position without moving. A first control signal is formed if the car moves in the aforementioned situation. Movement of the car is stopped on the basis of the first control signal with a separate stopping appliance (9) with respect to the brake of the drive machinery. The operating condition of the first movement detection means are tested with the second movement detection means (10, 11, 12) during driving of the car in order to detect a fault situation. A second control signal is formed for the elevator control when a fault situation is detected, in which case the elevator control drives the car to the next stopping floor and prevents the subsequent run of the car.

20 Claims, 1 Drawing Sheet

U.S. PATENT DOCUMENTS

Figure 1:
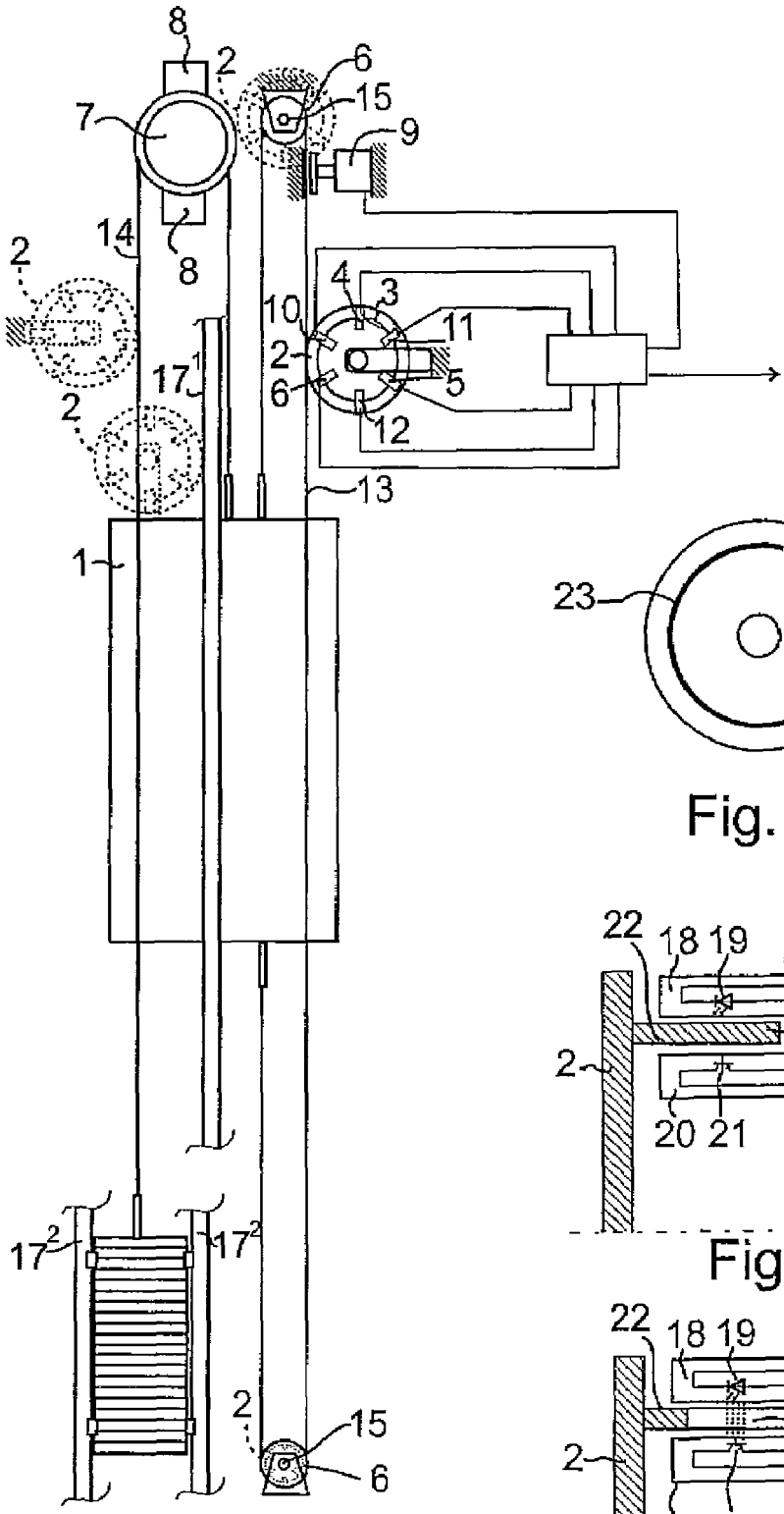

| | | | | |
|---|---|---|---|---|
| 2007/0056806 | A1 * | 3/2007 | Okamoto et al. | 187/290 |
| 2007/0089938 | A1 * | 4/2007 | Ishioka et al. | 187/391 |

FOREIGN PATENT DOCUMENTS

| | | | |
|---|---|---|---|
| EP | 0712804 | A1 | 5/1996 |
| GB | 2212782 | A | 8/1989 |
| JP | 2004-149231 | A | 5/2004 |
| WO | WO-2005/066058 | A2 | 7/2005 |

* cited by examiner

METHOD AND SYSTEM FOR DETECTING AND STOPPING UNCONTROLLED MOVEMENT OF AN ELEVATOR CAR IN AN ELEVATOR

This application is a Continuation of copending PCT International Application No. PCT/FI2007/000174 filed on Jun. 20, 2007, which designated the United States, and on which priority is claimed under 35 U.S.C. § 120. This application also claims priority under 35 U.S.C. § 119(a) on Patent Application No(s). 20060611 filed in Finland on Jun. 21, 2006, all of which are hereby expressly incorporated by reference into the present application.

FIELD OF THE INVENTION

The present invention relates to a method as defined in the preamble of claim 1. In addition, the present invention relates to a system as defined in the preamble of claim 5.

BACKGROUND OF THE INVENTION

Systems according to the preamble are prior art e.g. DE 20 2004 010 720 U1 and WO 2005/066058. The system comprises a movement detector, which is fitted to detect movement of the car when the machinery brake of the drive machinery is in the braking status with the purpose of holding the car in its position without moving. The movement detector forms a control signal if the car nevertheless moves undesirably in the aforementioned situation. A separate stopping appliance stops the movement of the car based on the aforementioned control signal.

The safety rules for elevators (SFS-EN 81-1 and revisions to it) give the possibility in the near future to equip an elevator with electronic safety equipment, the structural requirement for which is that it meets a certain SIL level (Safety Integrity Level) and that it incorporates a self-test function.

A problem in prior art systems for detecting and stopping uncontrolled movement is that they do not incorporate a self-test function, i.e. an inbuilt feature that detects equipment malfunction of an appliance.

PURPOSE OF THE INVENTION

The purpose of the invention is to eliminate aforementioned drawbacks.

In particular the purpose of the invention is to disclose a method with which an electronic safety device for uncontrolled movement can monitor its own operability by self-testing.

Another purpose of the invention is to disclose a corresponding system, which is provided with a self-test function.

SUMMARY OF THE INVENTION

The method and the arrangement according to the invention are characterized by what is disclosed in the characterization parts of claims 1 and 5. Other embodiments of the invention are characterized by what is disclosed in the other claims. Some inventive embodiments are also discussed in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some attributes contained in the claims below may be superfluous from the point of view of separate inventive concepts.

The features of the various embodiments can be applied within the scope of the basic inventive concept in conjunction with other embodiments.

In the method according to the invention movement of the car is detected with the first movement detection means when the brake of the drive machinery is in the braking status with the purpose of holding the car in its position without moving. A first control signal is formed if the car moves in the aforementioned situation. Movement of the car is stopped on the basis of the first control signal with a separate stopping appliance with respect to the brake of the drive machinery.

According to the invention the operating condition of the first movement detection means is tested with the second movement detection means during driving of the car in order to detect a fault situation. A second control signal is formed for the elevator control when a fault situation is detected. In a fault situation the car is driven by the elevator control to the next stopping floor and the subsequent car run is prevented.

In one embodiment of the method the operating condition of both the first and the second movement detection means are tested during driving of the car. A third control signal is formed for the elevator control when a fault situation is detected. The elevator is driven to the next stopping floor and drive of the car is prevented.

In one embodiment of the method when the sensors of the movement detection means are optical transmitter/receiver pairs, each of which comprises a transmitter for forming radiation and a receiver for receiving radiation, during driving of the car the radiation of all the transmitters is switched off, the status of all the receivers is detected, and a fault situation is detected if all the receivers are not in the same status. Optical branch photocells, for example, can function as these kinds of transmitter/receiver pairs, each of which comprises a first branch, which contains a transmitter for forming radiation, and a second branch, which contains a receiver for receiving radiation. When during driving of the car the radiation of all transmitters is switched off, the status of all the receivers is detected, and a fault situation is detected if all the receivers are not in the same status.

In one embodiment of the method an alarm is given in a fault situation to the remote control, and on the basis of the alarm a repairman is sent to the site to eliminate the fault and to permit drive of the car.

The system according to the invention comprises first movement detection means, which are fitted to detect movement of the car when the brake of the drive machinery is in the braking status with the purpose of holding the car in its position without moving, and to form a first control signal if the car moves in the aforementioned situation. The system further comprises a stopping appliance, which is separate with respect to the brake of the drive machinery, for stopping movement of the car on the basis of the first control signal.

The system according to the invention is arranged to be self-testing such that the system comprises second movement detection means, which are fitted to test the operating condition of the first movement detection means during driving of the car for detecting a fault situation, and in a fault situation to give to the elevator control a second control signal for preventing the subsequent run of the car.

One advantage of the invention is that uncontrolled movement can be controlled electronically while the operability of the system is simultaneously tested. Preferably these are arranged as an integrated function of the safety circuit of the elevator.

In one embodiment of the system the first movement detection means include a wheel, which is connected to a part of the elevator that moves along with the movement of the car such that the wheel rotates as the car moves. The wheel contains an excitation. A plurality of first optical sensors is arranged radially at equidistant intervals and fixed with respect to the wheel to detect the excitation as the wheel rotates for giving a first control signal.

In one embodiment of the system the wheel is arranged in tractive friction contact with a rope fixed to the car, such as the rope of the overspeed governor or the elevator rope.

In one embodiment of the system the wheel is fitted to the car on rotating bearings and arranged in tractive friction contact with the car guide rail.

In one embodiment of the system the wheel is fixed onto the shaft of the diverting pulley of the overspeed governor or is integrated into the diverting pulley of the overspeed governor.

In one embodiment of the system the stopping appliance is the safety gear, which grips the rope of the overspeed governor, the elevator rope or the guide rail, such as the car guide rail or the counterweight guide rail.

In one embodiment of the system when the brake of the drive machinery is in the braking status with the purpose of holding the car in its position without moving, the first detection means are arranged to give a first control signal when the excitation passes a predefined number of the first optical sensors.

In one embodiment of the system the second movement detection means comprise a plurality of second optical sensors, which are arranged radially at equidistant intervals and fixed with respect to the wheel to detect the excitation as the wheel rotates during driving of the car for monitoring rotation of the wheel, and for giving a second control signal if the wheel rotates at a smaller speed than the predefined speed and/or the wheel does not rotate during driving of the car.

In one embodiment of the system during driving of the car the second detection means are arranged to give a second control signal when the excitation passes the second optical sensors at a smaller speed than the predefined speed and/or the excitation does not pass the second optical sensors at all.

In one embodiment of the system the system comprises three units of first optical sensors, which are arranged at 120° intervals with respect to the rim of the wheel.

In one embodiment of the system the system comprises three units of second optical sensors, which are arranged at 120° intervals with respect to the rim of the wheel.

In one embodiment of the system the first optical sensors and/or the second optical sensors are transmitter/receiver pairs, each of which comprises a transmitter for forming radiation and a receiver for receiving radiation. Branch photocells, for example, can be used as these kinds of transmitter/receiver pairs, each of which comprises a first branch, which contains a transmitter for forming radiation, and a second branch, which contains a receiver for receiving radiation.

In one embodiment of the system the wheel comprises a ring-like flange extending in the axial direction from the side of the wheel in the proximity of the outer rim, on one side of which is the transmitter of each transmitter/receiver pair and on the opposite side of which flange is the receiver of each transmitter/receiver pair, such that the flange is between the transmitter and the receiver. On the flange is a first area that is impervious to radiation, which prevents the passage of radiation from the transmitter to the receiver, and a second area that allows the passage of radiation from the transmitter to the receiver. The second area forms the aforementioned excitation.

In one embodiment of the system, the system is fitted for pre-fitting and/or retrofitting irrespective of the elevator type.

LIST OF FIGURES

Figure 2:
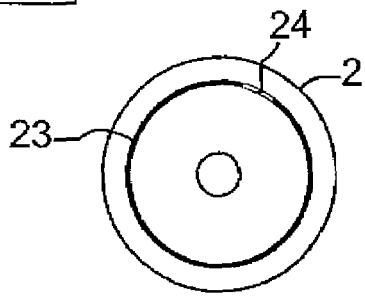
Figure 3:
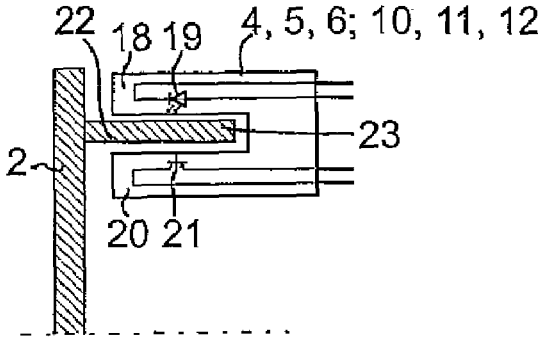
Figure 4:
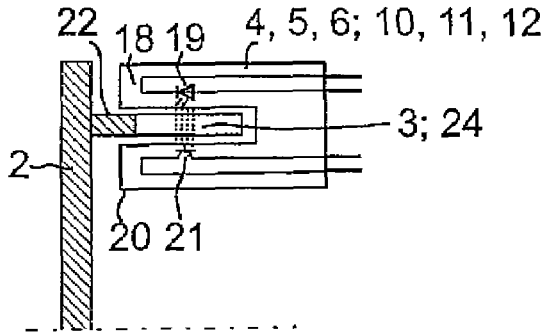

In the following, the invention will be described in detail by the aid of a few examples of its embodiments with reference to the attached drawings, wherein FIG. 1 diagrammatically presents one embodiment of the system according to the invention, FIG. 2 diagrammatically presents the wheel incorporated in the movement detection means of the system of FIG. 1, FIG. 3 diagrammatically presents a cross-section of the wheel of FIG. 2, when the area of the flange of the wheel that is impervious to radiation is at the point of an optical sensor, and FIG. 4 presents the wheel of FIG. 3 when the area of its flange that is pervious to radiation and that functions as an excitation is at the point of the optical sensor.

DETAILED DESCRIPTION OF THE INVENTION

FIG. 1 presents a system for detecting and stopping uncontrolled movement of the car of an elevator, which is provided with an arrangement for self-testing and monitoring of operation. Although FIG. 1 presents a traction sheave elevator with counterweight as an example of an application site, the system is suited to any type of prior art elevator, thus it is suited to traction sheave elevators with counterweight or without counterweight, to hydraulic elevators, to elevators without machine room, to elevators with machine room, to rope-driven elevators, to belt-driven elevators, etc. It can be retrofitted in old elevators in conjunction with their modernization or installed into new elevators at the factory.

The system comprises first movement detection means 2, 3, 4, 5, 6, which detect movement of the car in a situation in which the brake 8 of the drive machinery 7 is in the braking status, the purpose of which braking status is to hold the car in its position without moving. The brake 8 acts directly on the traction sheave of the drive machinery and closes by itself when the electrical power holding it open dissipates. The first movement detection means form a first control signal if the car nevertheless moves while the brake 8 is on. The system further comprises a stopping appliance 9, which is separate with respect to the brake of the drive machinery, for stopping movement of the car on the basis of the first control signal. The stopping appliance 9 is arranged to function in the aforementioned situation as a holding brake that brakes movement and holds in position. At its most simple the stopping appliance 9 is the safety gear, which grips the rope 13 of the overspeed governor, such as in the embodiment of FIG. 1. In another embodiment the safety gear 9 can grip the elevator rope 14 or the guide rail, such as the car guide rail $\mathbf{17}^1$ or the counterweight guide rail $\mathbf{17}^2$.

The system is self-testing such that the system comprises second movement detection means 10, 11, 12, which test the operating condition of the first movement detection means 2, 4, 5, 6 during each run of the car to detect any fault situation. In a fault situation the elevator control receives a second control signal, on the basis of which the elevator control still allows driving of the car in the driving direction to the nearest stopping floor, but prevents the subsequent run of the car before the resetting and restarting of the system ("Start permit"), which can be performed by an elevator serviceman with a setting of the switch after automatically receiving an alarm about the fault situation, e.g. via the remote control, and after the defect is repaired.

As shown in FIGS. 1 and 2, the first movement detection means comprise a wheel 2, which is in tractive friction contact with a rope fixed to the car 1, in this case with the rope 13 of the overspeed governor. In another embodiment, which is sketched in FIG. 1 with a dashed line, the wheel 2 is fitted to the car 1 on rotating bearings and arranged in tractive friction contact with the car guide rail $\mathbf{17}^1$. In another embodiment the wheel 2 can be in friction contact with the elevator rope 14, as is sketched in the figure with a dashed line. It is also possible to arrange the wheel 2 to move in synchronization with the diverting pulley 15 of the overspeed governor, in which case the wheel can be fixed to the shaft 16 of the diverting pulley 15 of the overspeed governor or be integrated with the diverting pulley 15 of the overspeed governor as outlined by the dashed line sketched in FIG. 1. The main criterion is that the wheel 2 is able to rotate according to the movement of the car 1, i.e. such that the wheel always rotates when the car moves. The wheel 2 contains at least one excitation 3. Three units of the first optical sensors 4, 5, 6 are arranged around the wheel 2 in rim-like formation and radially at equidistant intervals at angles of 120° and are installed to remain in fixed position with respect to the wheel. The first optical sensors 4, 5, and 6 detect the excitation 3 as the wheel 2 rotates and give a first control signal to bring the stopping appliance 9 into operation if the car moves when the machinery brake 8 is on. When the brake 8 of the drive machinery 7 is in the braking status with the purpose of holding the car 1 in its position without moving, the first detection means 2 . . . 6 are arranged to give a first control signal when the excitation 3 passes a predefined number of the first optical sensors 4, 5, 6. For example, it can be defined that when the excitation 3 passes two of the first optical sensors 4, 5, 6, this triggers the first control signal for placing the stopping appliance 9 in the holding position. Since there are numerous first optical sensors 4, 5, 6, in this example case three units, and two functioning sensors are sufficient to detect movement of the wheel 2, the system can also operate when one sensor is defective.

The second movement detection means for monitoring and testing the operation of the system comprise three units of the second optical sensors 10, 11, 12, which are arranged around the wheel 2 in rim-like formation and radially at equidistant intervals at angles of 120° and are installed to remain in fixed position with respect to the wheel. As the wheel 2 rotates during driving of the car the second optical sensors 10, 11, 12 monitor that the wheel 2 actually rotates and that e.g. slipping between the wheel 2 and the rope 13 of the overspeed governor does not occur. By means of the second optical sensors 10, 11, 12 it is possible e.g. to calculate the speed of the car 1. If during driving of the car the speed of the car 1 is below a certain set value, e.g. 0.02 m/s, this is deemed to mean that the tractive friction of the wheel 2 is slipping, which is a fault situation, and the second control signal is triggered, on the basis of which the car is driven by the elevator control in the driving direction to the next stopping floor and the subsequent run of the car is prevented. The elevator control gives an alarm to the remote control, on the basis of which a repairman comes to the site to eliminate the fault and to permit drive of the car. In this example there are three optical sensors 10, 11, 12, so that in principle just one is sufficient to detect movement of the wheel 2, so the system can operate also when one or two sensors are defective.

FIG. 2 presents the wheel 2, which contains a ring-like flange 22, containing an excitation 3, extending in the axial direction from the side of the wheel in the proximity of the outer rim.

As illustrated in FIGS. 3 and 4, the first optical sensors 4, 5, 6 and the second optical sensors 10, 11, 12 are the transmitter/receiver pairs 19, 21. They can be, for example, branch photocells or similar, each of which comprises a first branch 18, which contains a transmitter 19 for forming radiation, and a second branch 20, which contains a receiver 21 for receiving radiation. Also other types of transmitter/receiver pairs can be used.

The first branch 18 of each transmitter/receiver pair 4, 5, 6, 10, 11, 12 extends above the flange 22 and the second branch 20 extends below the flange so that the flange 22 is between the first and the second branch 18, 20 and thus between the transmitter 19 and the receiver 21. The second area 24, which is pervious to radiation, in the flange 22 forms the excitation 3, which can be e.g. an aperture in the flange. The first area 23, which is impervious to radiation, for its part prevents the passage of radiation from the transmitter 19 to the receiver 21. The second area 24 allows the passage of radiation from the transmitter 19 to the receiver 21 forming the excitation 3.

The system further comprises a self-testing function of the transmitter/receiver pairs 4, 5, 6, 10, 11, 12. During driving of the car the operating condition of the transmitter/receiver pairs is tested. A third control signal is given to the elevator control when a fault situation is detected, the elevator is driven to the next stopping floor and drive of the car is prevented. During driving of the car the radiation of all the transmitters 19 is switched off and the status of all the receivers 21 is detected. A fault situation is detected if all the receivers 21 are not then in the same status.

It is obvious to the person skilled in the art that the invention is not limited to the embodiments described above, in which the invention is described using examples, but that many adaptations and different embodiments of the invention are possible within the scope of the inventive concept defined by the claims presented below.

LIST OF REFERENCE NUMBERS car (1)
first movement detection means (2, 3, 4, 5, 6)
  wheel (2)
  excitation (3)
  first optical sensor (4, 5, 6)
drive machinery (7)
brake (8)
stopping appliance (9)
second movement detection means (10, 11, 12)
  second optical sensor (10, 11, 12)
rope of overspeed governor (13)
elevator rope (14)
diverting pulley of overspeed governor (15)
shaft (16)
car guide rail ($17^1$)
counterweight guide rail ($17^2$)
first branch (18)
transmitter (19)
second branch (20)
receiver (21)
flange (22)
first area impervious to radiation (23)
second area pervious to radiation (24)

The invention claimed is:

1. A method for detecting and stopping uncontrolled movement of the car in an elevator, comprising the steps of:

detecting movement of the car with first movement detection means when the brake of the drive machinery is in the braking status with the purpose of holding the car in its position without moving, forming a first control signal if the car moves in the aforementioned situation, and stopping movement of the car on the basis of the first control signal with a separate stopping appliance with respect to the brake of the drive machinery, testing the operating condition of the first movement detection means with the second movement detection means during driving of the car in order to detect a fault situation, forming a second control signal for the elevator control when a fault situation is detected, driving the car to the next stopping floor by the elevator control, and preventing the subsequent run of the car.

2. The method according to claim 1, further comprising the steps of:

testing the operating condition of both the first and the second movement detection means during driving of the car, and forming a third control signal for the elevator control when a fault situation is detected, driving the elevator to the next stopping floor, and preventing drive of the car.

3. The method according to claim 1, wherein when the sensors of the movement detection means are optical transmitter/receiver pairs, each of which comprises a transmitter for forming radiation and a receiver for receiving radiation, during driving of the car the radiation of all transmitters is switched off, the status of all the receivers is detected, and a fault situation is detected if all the receivers are not in the same status.

4. The method according to claim 1, further comprising the steps of:

giving an alarm in a fault situation to the remote control, and on the basis of the alarm sending a repairman to the site to eliminate the fault and to permit drive of the car.

5. A system for detecting and stopping uncontrolled movement of the car in an elevator, comprising:

a first movement detector fitted to detect movement of the car when the brake of the drive machinery is in the braking status with the purpose of holding the car in its position without moving, and to form a first control signal if the car moves in the aforementioned situation, and a stopping appliance, which is separate with respect to the brake of the drive machinery, for stopping movement of the car on the basis of the first control signal, wherein the system is arranged to be self-testing such that the system comprises a second movement detector fitted to test the operating condition of the first movement detector during driving of the car to detect any fault situation, and in a fault situation to give to the elevator control a second control signal for preventing the subsequent run of the car.

6. The system according to claim 5, wherein the first movement detector comprises:

a wheel, which is connected to a part of the elevator that moves along with the movement of the car such that the wheel rotates as the car moves, an excitation, which is in the wheel, and a plurality of optical sensors, which are arranged radially at equidistant intervals and fixed with respect to the wheel to detect the excitation as the wheel rotates for giving the first control signal.

7. The system according to claim 6, wherein the wheel is arranged in tractive friction contact with a rope fixed to the car such as with rope of the overspeed governor or with the elevator rope.

8. System according to claim 6, wherein the wheel is fitted to the car on rotating bearings and arranged in tractive friction contact with the car guide rail.

9. System according to claim 6, wherein the wheel is fixed onto the shaft of the diverting pulley of the overspeed governor or is integrated into the diverting pulley of the overspeed governor.

10. The system according to claim 5, wherein the stopping appliance is the safety gear, which grips hold of the rope of the overspeed governor, the elevator rope or the guide rail, such as the car guide rail or the counterweight guide rail.

11. The system according to claim 5, wherein when the brake of the drive machinery is in the braking status with the purpose of holding the car in its position without moving, the first detector is arranged to give a first control signal when the excitation passes a predefined number of the first optical sensors.

12. The system according to claim 1, wherein the second movement detector comprises:

a plurality of second optical sensors, which are arranged radially at equidistant intervals and fixed with respect to the wheel to detect the excitation as the wheel rotates during driving of the car for monitoring rotation of the wheel and for giving the second control signal, if the wheel rotates at a smaller speed than the predefined speed and/or the wheel does not rotate during driving of the car.

13. The system according to claim 5, wherein during driving of the car the second detector is arranged are arranged to give a second control signal when the excitation passes the second optical sensors at a smaller speed than the predefined speed and/or the excitation does not pass the second optical sensors at all.

14. The system according to claim 5, wherein the system comprises three units of first optical sensors, which are arranged at 120° intervals with respect to the rim of the wheel.

15. The system according to claim 5, wherein the system comprises three units of second optical sensors, which are arranged at 120° intervals with respect to the rim of the wheel.

16. The system according to claim 5, wherein the first optical sensors and/or the second optical sensors are transmitter/receiver pairs, which comprise a transmitter for forming radiation and a receiver for receiving radiation.

17. The system according to claim 16, wherein the wheel comprises a ring-like flange extending in the axial direction from the side of the wheel in the proximity of the outer rim, on one side of which is the transmitter of each transmitter/receiver pair and on the opposite side of which flange is the receiver of each transmitter/receiver pair, such that the flange is between the transmitter and the receiver, and on which flange is a first area that is impervious to radiation, which prevents the passage of radiation from the transmitter to the receiver, and a second area that allows the passage of radiation from the transmitter to the receiver and which second area forms the aforementioned excitation.

18. The system according to claim 5, wherein the system is fitted for pre-fitting and/or retrofitting irrespective of the elevator type.

19. The method according to claim 2, further comprising the steps of:

giving an alarm in a fault situation to the remote control, and on the basis of the alarm sending a repairman to the site to eliminate the fault and to permit drive of the car.

20. The method according to claim 3, further comprising the steps of:

giving an alarm in a fault situation to the remote control, and on the basis of the alarm sending a repairman to the site to eliminate the fault and to permit drive of the car.

* * * * *